US008167299B2

(12) United States Patent
Shirasaki

(10) Patent No.: US 8,167,299 B2
(45) Date of Patent: May 1, 2012

(54) SHEET FEEDER AND IMAGE FORMING APPARATUS PROVIDED WITH THE SHEET FEEDER

(75) Inventor: Seiichi Shirasaki, Osaka (JP)

(73) Assignee: Kyocera Mita Corporation (JP)

( * ) Notice: Subject to any disclaimer, the term of this patent is extended or adjusted under 35 U.S.C. 154(b) by 207 days.

(21) Appl. No.: 12/177,410

(22) Filed: Jul. 22, 2008

(65) Prior Publication Data

US 2009/0033023 A1 Feb. 5, 2009

(30) Foreign Application Priority Data

Jul. 30, 2007 (JP) ..... 2007-197062

(51) Int. Cl.
*B65H 3/52* (2006.01)

(52) U.S. Cl. ..... 271/125; 271/121; 271/167

(58) Field of Classification Search ..... 271/167, 271/121, 122, 10.11
See application file for complete search history.

(56) References Cited

U.S. PATENT DOCUMENTS

| | | | | |
|---|---|---|---|---|
| 4,822,023 | A * | 4/1989 | Miyoshi | 271/118 |
| 5,584,475 | A | 12/1996 | Asada et al. | |
| 7,384,034 | B2 * | 6/2008 | Nagura et al. | 271/125 |
| 2006/0180989 | A1 * | 8/2006 | Seike et al. | 271/121 |
| 2006/0180990 | A1 * | 8/2006 | Ueda et al. | 271/121 |
| 2007/0290429 | A1 * | 12/2007 | Nakashima et al. | 271/10.11 |
| 2008/0061491 | A1 * | 3/2008 | Nakashima | 271/10.11 |

FOREIGN PATENT DOCUMENTS

| | | | |
|---|---|---|---|
| JP | 05069975 | A * | 3/1993 |
| JP | 7-309465 | | 11/1995 |
| JP | 11-188946 | | 7/1999 |
| JP | 2003-307890 | | 10/2003 |

* cited by examiner

*Primary Examiner* — Kaitlin Joerger
(74) *Attorney, Agent, or Firm* — Gerald E. Hespos; Michael J. Porco

(57) ABSTRACT

A sheet feeder is provided with a storing section for storing transfer sheets, a feed roller for feeding the transfer sheets stored in the storing section one by one from the uppermost one; a separation roller arranged to face the feed roller; a transport roller arranged downstream of the feed roller in a transport direction; and a transfer sheet guide for guiding the transfer sheet to the transport roller, wherein the transfer sheet guide includes a guide face formed to extend from the storing section along the transport direction of the transfer sheet on or in a vicinity of an extension of a line tangent to the feed roller and the transport roller on the side of transporting the transfer sheet, the guide face being formed in an area between the storing section and the separation roller.

9 Claims, 11 Drawing Sheets

SHEET FEEDER AND IMAGE FORMING APPARATUS PROVIDED WITH THE SHEET FEEDER

BACKGROUND OF THE INVENTION

1. Field of the Invention

The present invention relates to a sheet feeder provided with a sheet conveyance guide mechanism used in an image forming apparatus such as a printer, a copier, a facsimile machine or a complex machine having multiple functions of these, and an image forming apparatus provided with this sheet feeder.

2. Description of the Related Art

Conventionally, as sheet feeders used in image forming apparatuses such as printers, copiers, facsimile machines and complex machines having multiple functions of these, those which can be detachably mounted into apparatus main bodies and which are provided with sheet cassettes for storing a plurality of transfer sheets have been widely used.

For sheet cassettes to be used in the foregoing image forming apparatus, for example, a sheet cassette 113 shown in FIG. 10 may be adopted. As shown in FIG. 10, the sheet cassette 113 is in the form of a drawer so that transfer sheets can be replenished and exchanged by pulling out the sheet cassette 113 from the image forming apparatus main body.

The sheet cassette 113 is provided with a storing section 101 for storing therein transfer sheets, a lifter plate 102 for lifting the transfer sheets stored in the storing section 101 along a sloping face in a sheet feeding direction (upward in FIG. 10), a separation roller 103 disposed downstream of the lifter plate 102 in a transport direction, a transfer sheet guide 104 provided around the separation roller 103 in such a manner as to expose an upper end portion of the separation roller 103 and inclined upwardly in the transport direction, and transport rollers 105 disposed downstream of the transfer sheet guide 104.

As shown in FIG. 11, a pickup roller 106 is disposed above (on side where the transfer sheets are to be placed) a downstream end of the lifter plate 102 in the transport direction. The separation roller 103 and the transport rollers 105 of the sheet cassette 113 shown in FIG. 10 are arranged to respectively face a feed roller 107 and a transport roller 108 in a state where the sheet cassette 113 is mounted in the apparatus main body (overall view is not shown).

The transfer sheets placed on the lifter plate 102 are fed one by one from the uppermost one by the rotations of the pickup roller 106 with the uppermost one pressed against the pickup roller 106, and are conveyed to pass between the feed roller 107 and the separation roller 103. Only the uppermost one of the transfer sheets as fed by the pickup roller 106 passes between the transport rollers 105 and 108 and is transported to an image forming section (not shown) provided in the apparatus main body by the rotations of the feed roller 107 in the transport direction and the rotations of the separation roller 103 in a direction opposite to the transport direction. At this time, the transfer sheet is guided by the transfer sheet guide 104.

Here, a downstream end in the transport direction of the transfer sheet as fed by the pickup roller 106 may hang down in some cases due to softness peculiar to the transfer sheet as shown in FIG. 11. If the leading end of the transfer sheet hangs down from an upper surface 104*a* (guide face) of the transfer sheet guide 104 in this way, it collides with a vertical wall surface 101*a* of the storing section 101 to create a hitting sound. Further, if the transfer sheet having collided with the vertical wall surface 101*a* enters a clearance between the transfer sheet guide 104 and the vertical wall surface 101*a* without being placed on the upper surface 104*a* of the transfer sheet guide 104, a sheet jam is liable to occur, which creates a large impact sound.

In view of this problem, Japanese Unexamined Patent Publication No. 2003-307890 (date of publication: Oct. 31, 2003) discloses a noise eliminating mechanism capable of easily adjusting noise according to a noise source.

Japanese Unexamined Patent Publication No. H11-188946 (Patent No. 3605786) (date of publication: Jul. 13, 1999) discloses technology for suppressing the leakage of noise to the outside by effectively sealing a clearance between an automatic duplex unit (ADU) and an ADU cassette.

Further, Japanese Unexamined Patent Publication No. H07-309465 (Patent No. 3448097) (date of publication: May 19, 1994; corresponding U.S. Pat. No. 5,584,475) discloses technology for reducing noise generation by arranging a noise eliminating member made of a material having a small coefficient of friction downstream of a separation pad made of a material having a large coefficient of friction in a transport direction and arranging the circumferential surface of a feed roller to cross over the separation pad and the noise eliminating member.

However, any of the above prior art documents merely discloses the technology for reducing noise generation and therefore fails to fundamentally solve a problem of a transfer sheet conveyance failure, which causes the generation of noise and a jam. This problem has been particularly difficult to solve in the case of using thick transfer sheets or hard transfer sheets.

SUMMARY OF THE INVENTION

An object of the present invention is to provide a sheet feeder capable of reducing the generation of noise and a jam resulting from a transfer sheet conveyance failure by stably guiding to a transport path, a transfer sheet as fed from a storing section, and an image forming apparatus provided with such a sheet feeder.

In order to accomplish the above object, one aspect of the present invention is directed to a sheet feeder, comprising: a storing section for storing transfer sheets; a feed roller for feeding the transfer sheets stored in the storing section one by one from the uppermost one; a separation roller arranged to face the feed roller; a transport roller arranged downstream of the feed roller in a transport direction; and a transfer sheet guide for guiding the transfer sheet to the transport roller, wherein the transfer sheet guide includes a guide face formed to extend from the storing section along the transport direction of the transfer sheet on or in a vicinity of an extension of a line tangent to the feed roller and the transport roller on the side of transporting the transfer sheet, the guide face being formed in an area between the storing section and the separation roller.

Another aspect of the present invention is directed to an image forming apparatus, comprising a sheet feeder and an image forming apparatus main body for forming an image on a transfer sheet as fed from the sheet feeder, wherein the sheet feeder have the above construction.

These and other objects, features, aspects and advantages of the present invention will become more apparent upon a reading of the following detailed description and accompanying drawings.

DETAILED DESCRIPTION OF THE PREFERRED EMBODIMENTS

Hereinafter, one embodiment of the present invention is described in detail with reference to the accompanying drawings.

Figure 1:
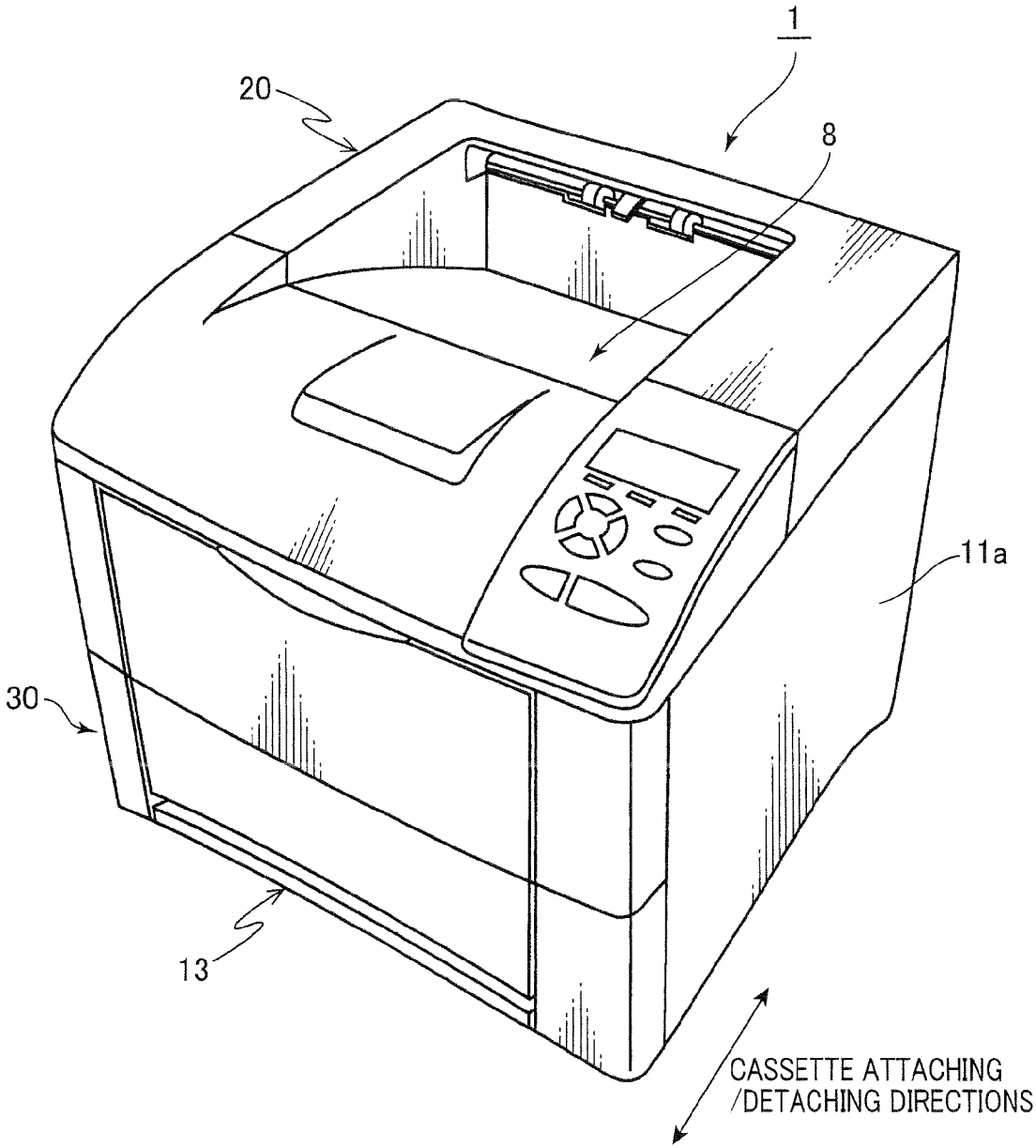
FIG. 1 is a perspective view of a printer provided with a sheet feeder according to one embodiment of the invention.
Figure 2:
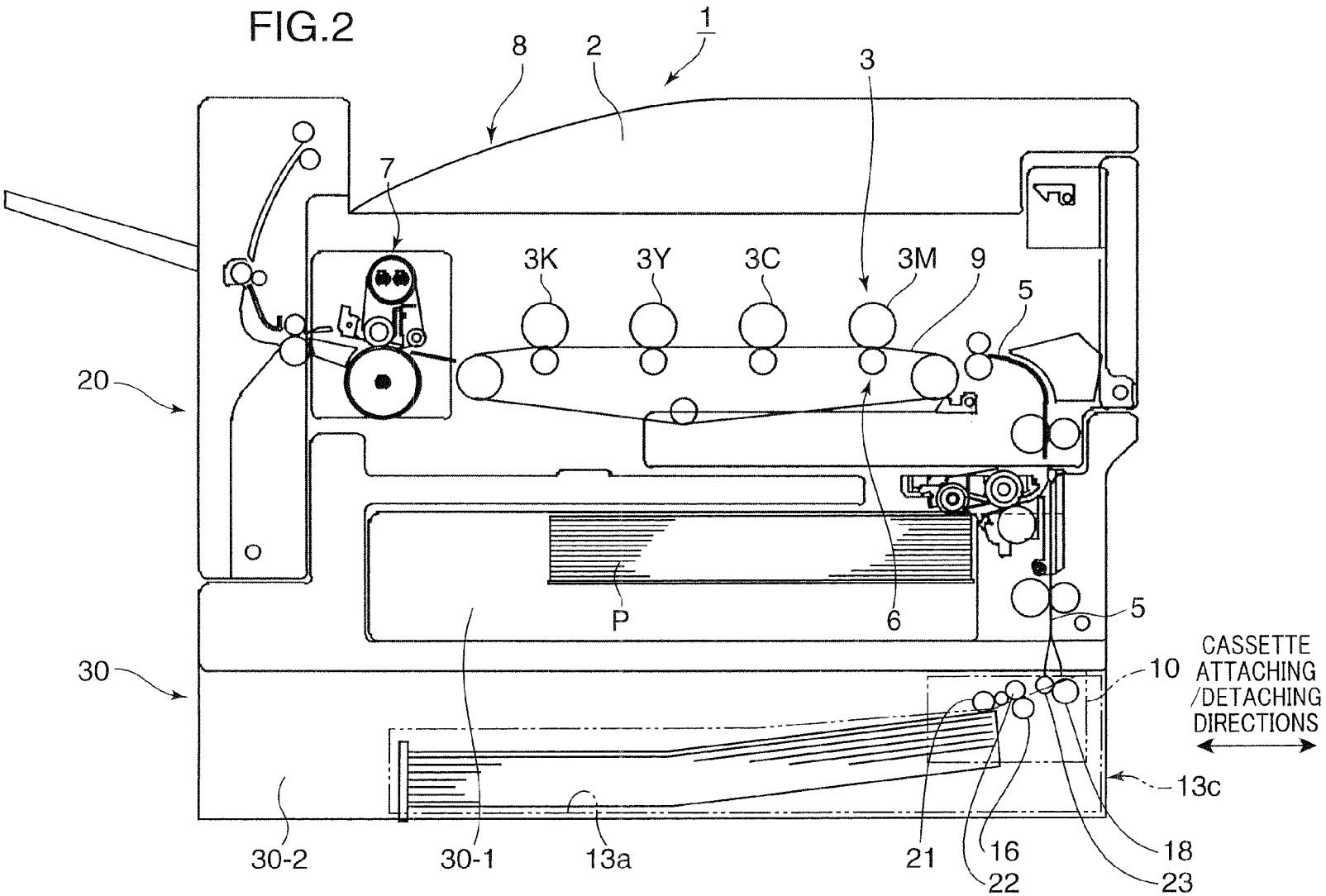
FIG. 2 is a section showing the internal construction of the printer shown in FIG. 1.
Figure 3:
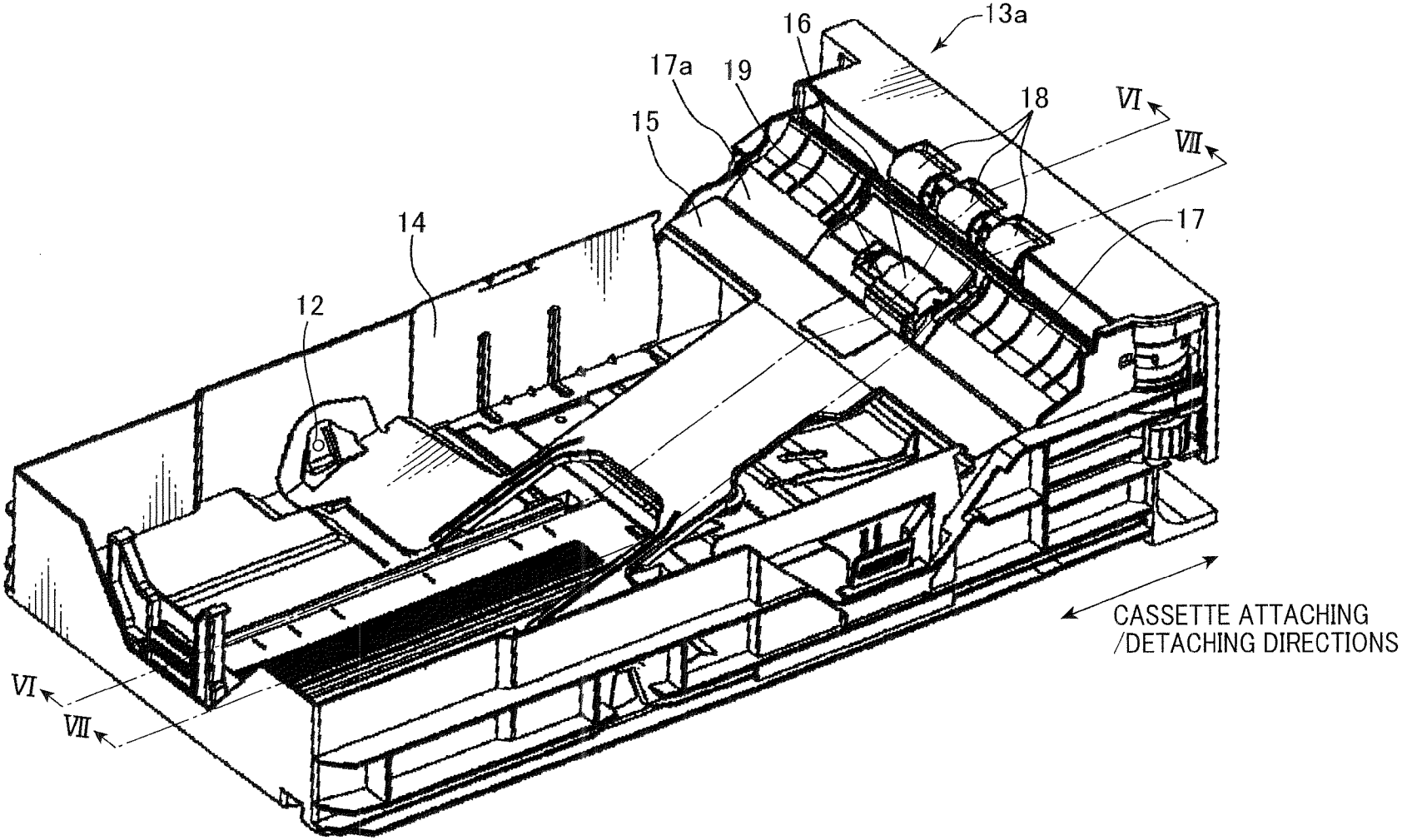
FIG. 3 is a perspective view showing a sheet cassette constituting the sheet feeder according to the embodiment of the invention.
Figure 4:
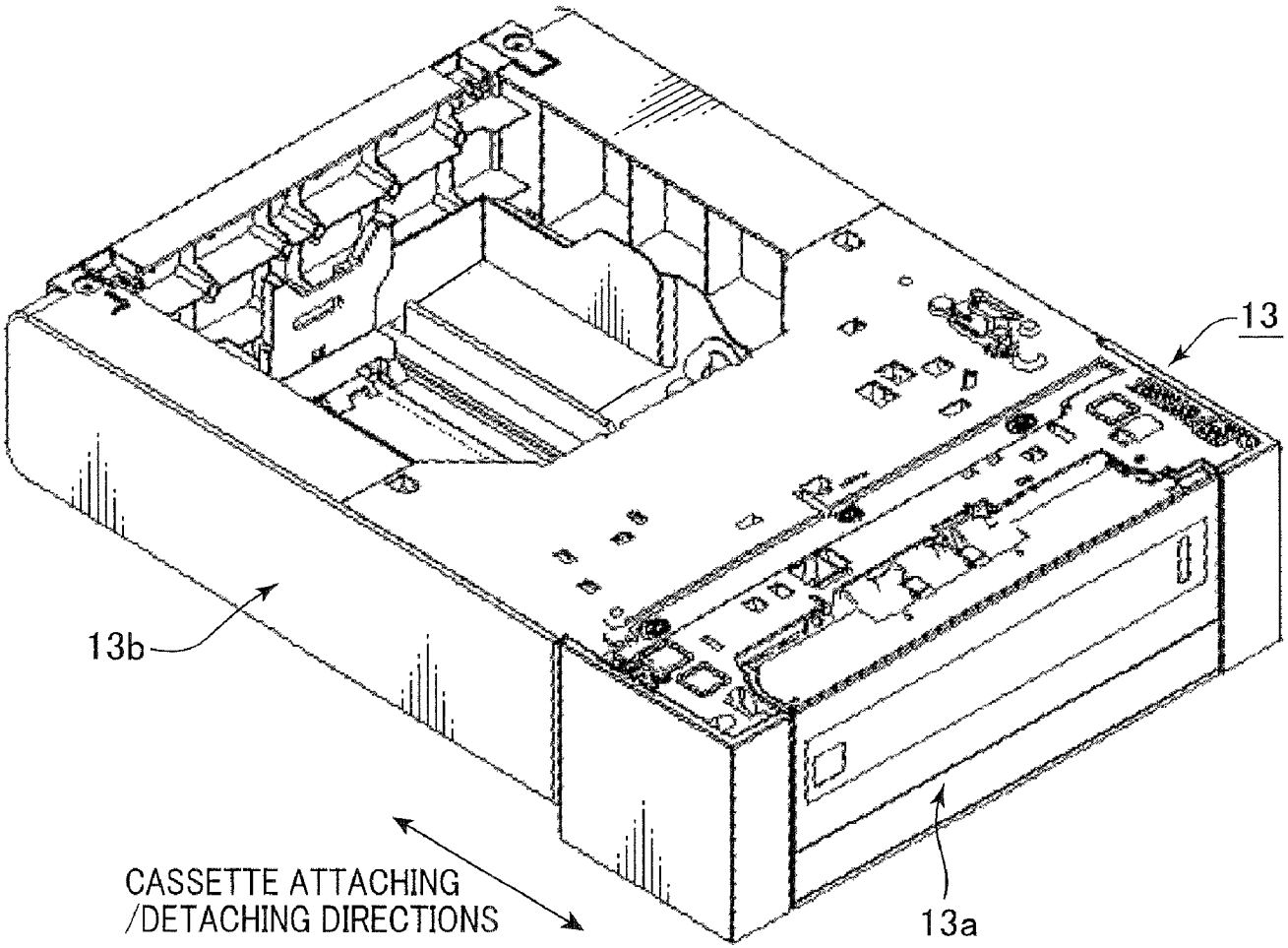
FIG. 4 is a perspective view showing the external appearance of the sheet feeder according to the embodiment of the invention.
Figure 5:
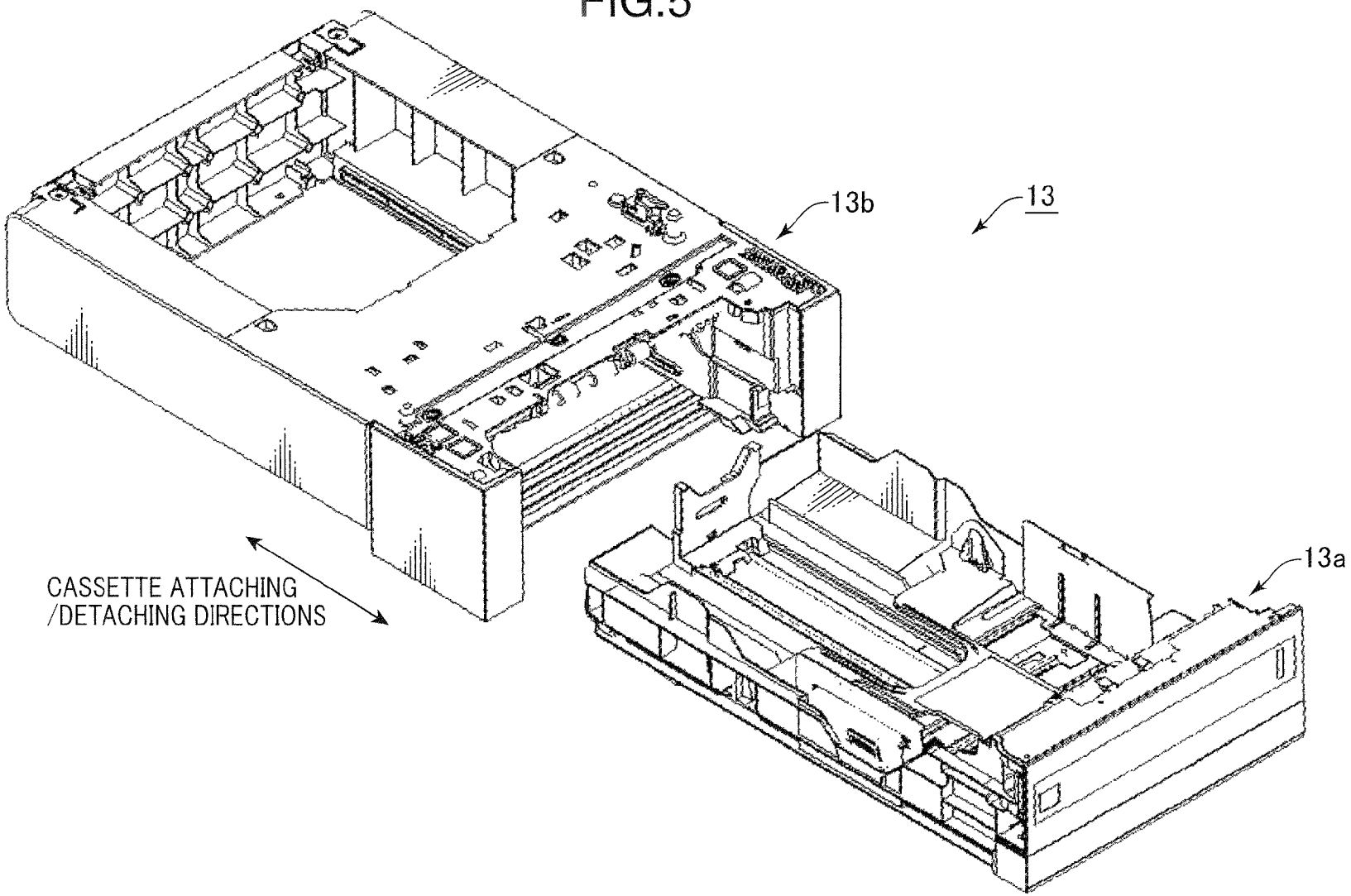
FIG. 5 is a diagram showing a state where the sheet cassette of the sheet feeder shown in FIG. 4 is drawn from a sheet feeder main body.
Figure 6:
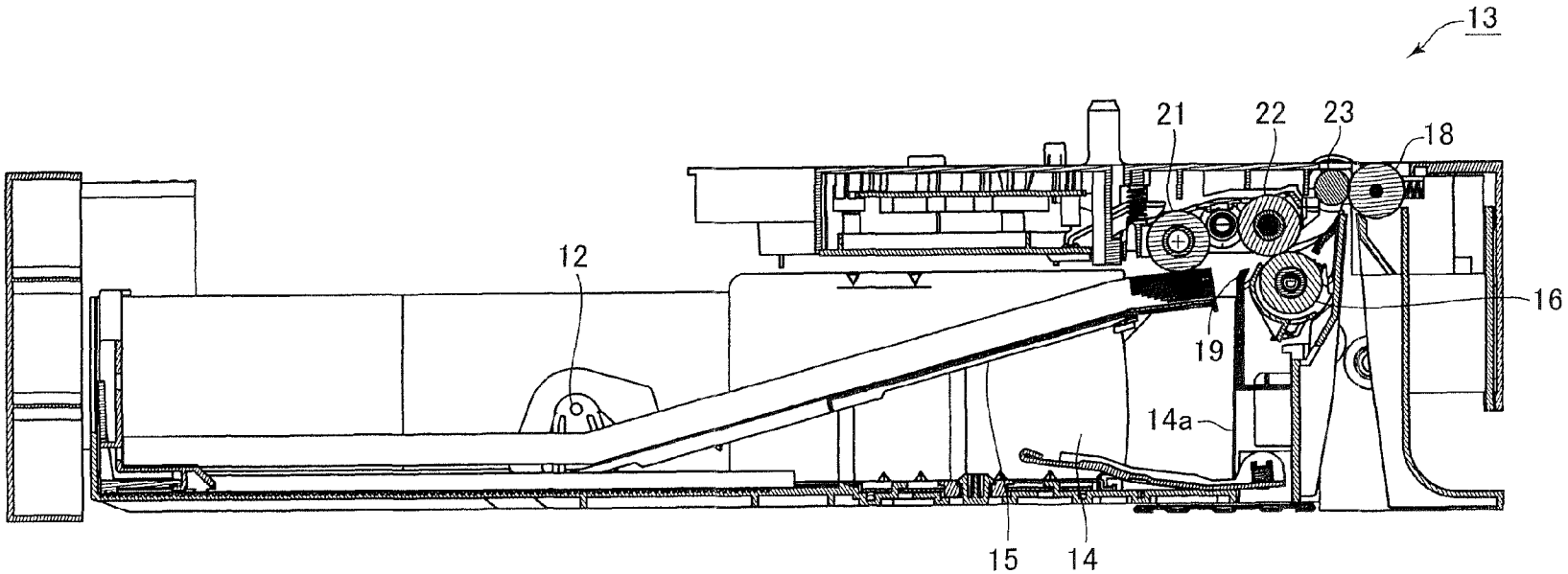
FIG. 6 is a section along VI-VI of the sheet cassette shown in FIG. 3.
Figure 7:
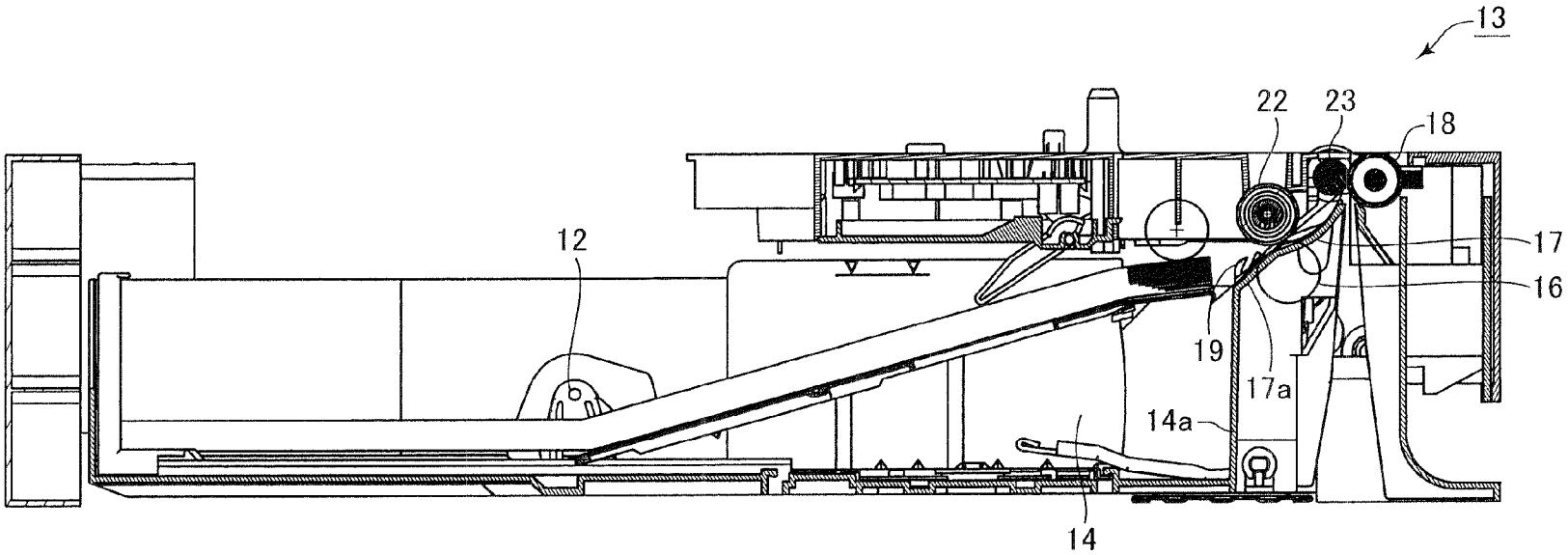
FIG. 7 is a section along VII-VII of the sheet cassette shown in FIG. 3.
Figure 8:
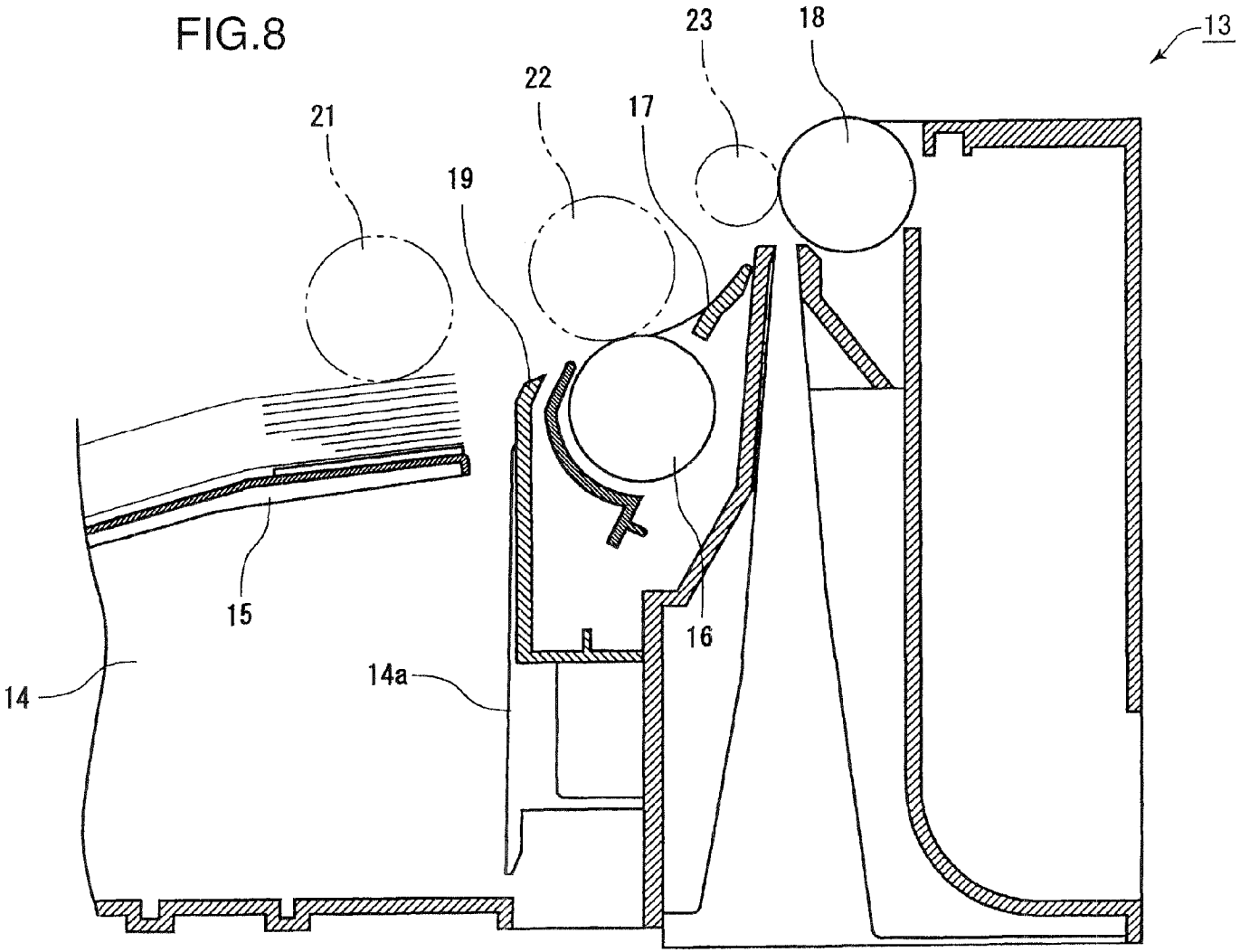
FIG. 8 is a section showing an essential portion of the sheet feeder shown in FIG. 6.
Figure 9:
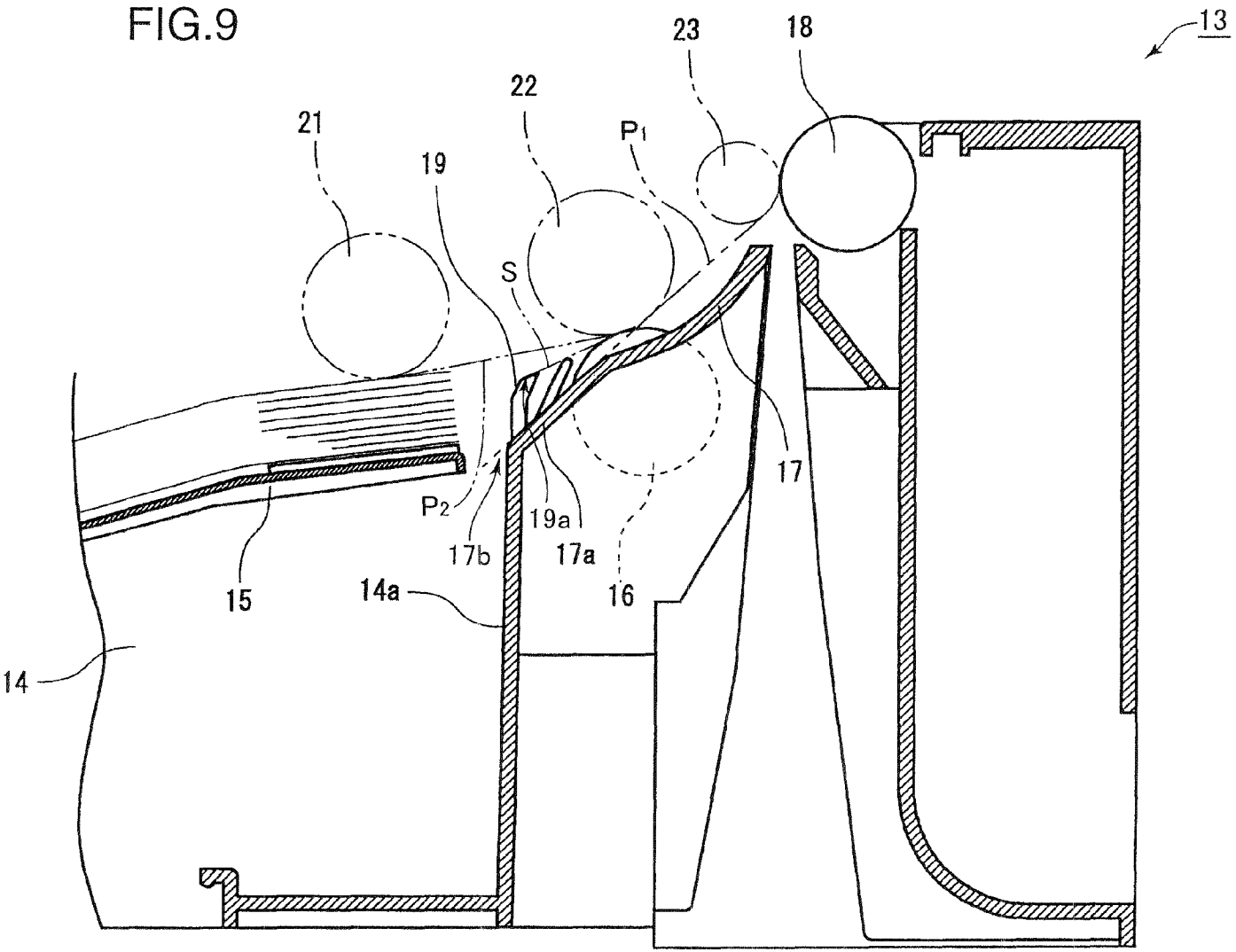
FIG. 9 is a section showing an essential portion of the sheet feeder shown in FIG. 7.
Figure 10:
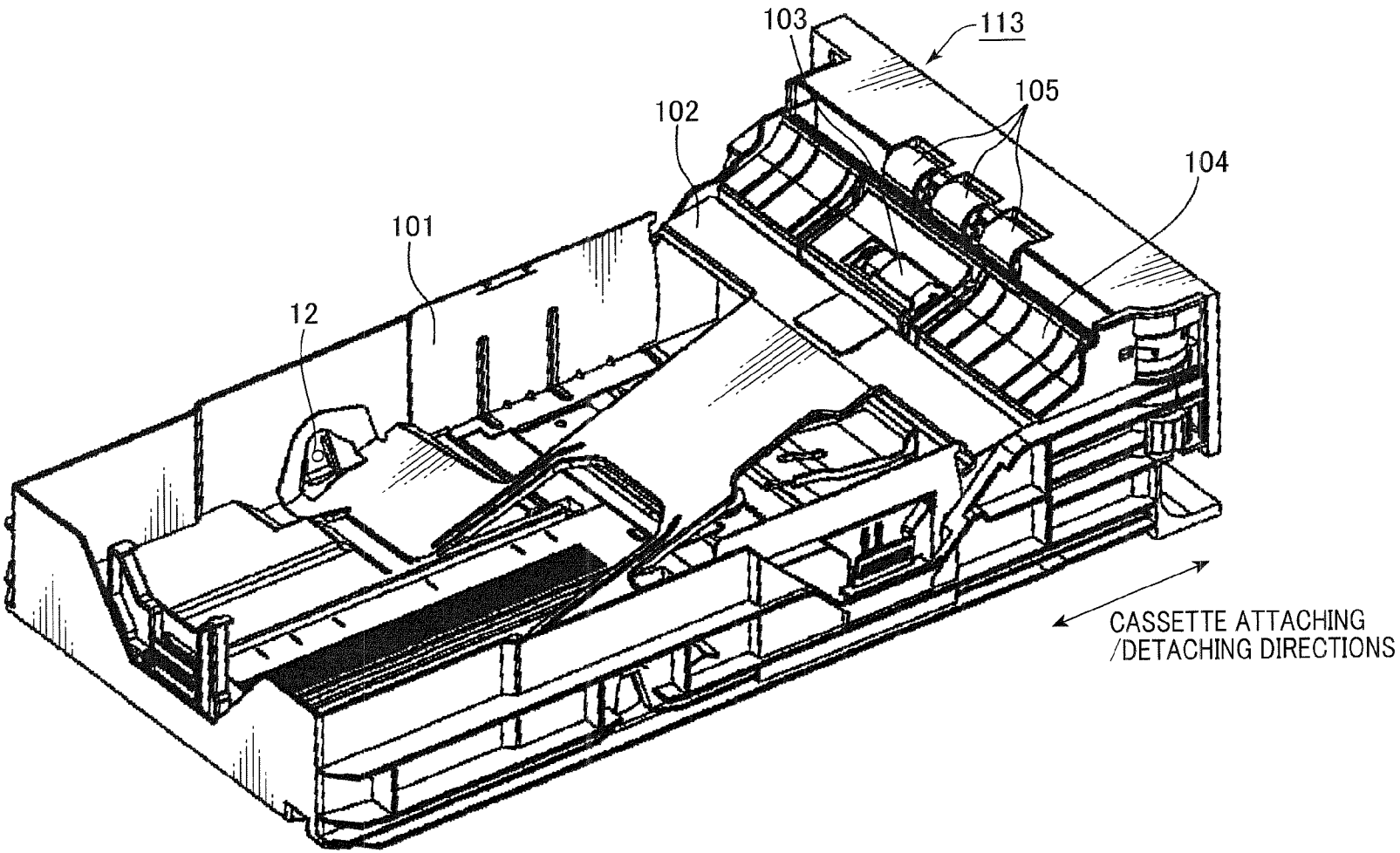
PRIOR ART FIG.10
FIG. 10 is a perspective view showing a sheet cassette constituting a conventional sheet feeder.
Figure 11:
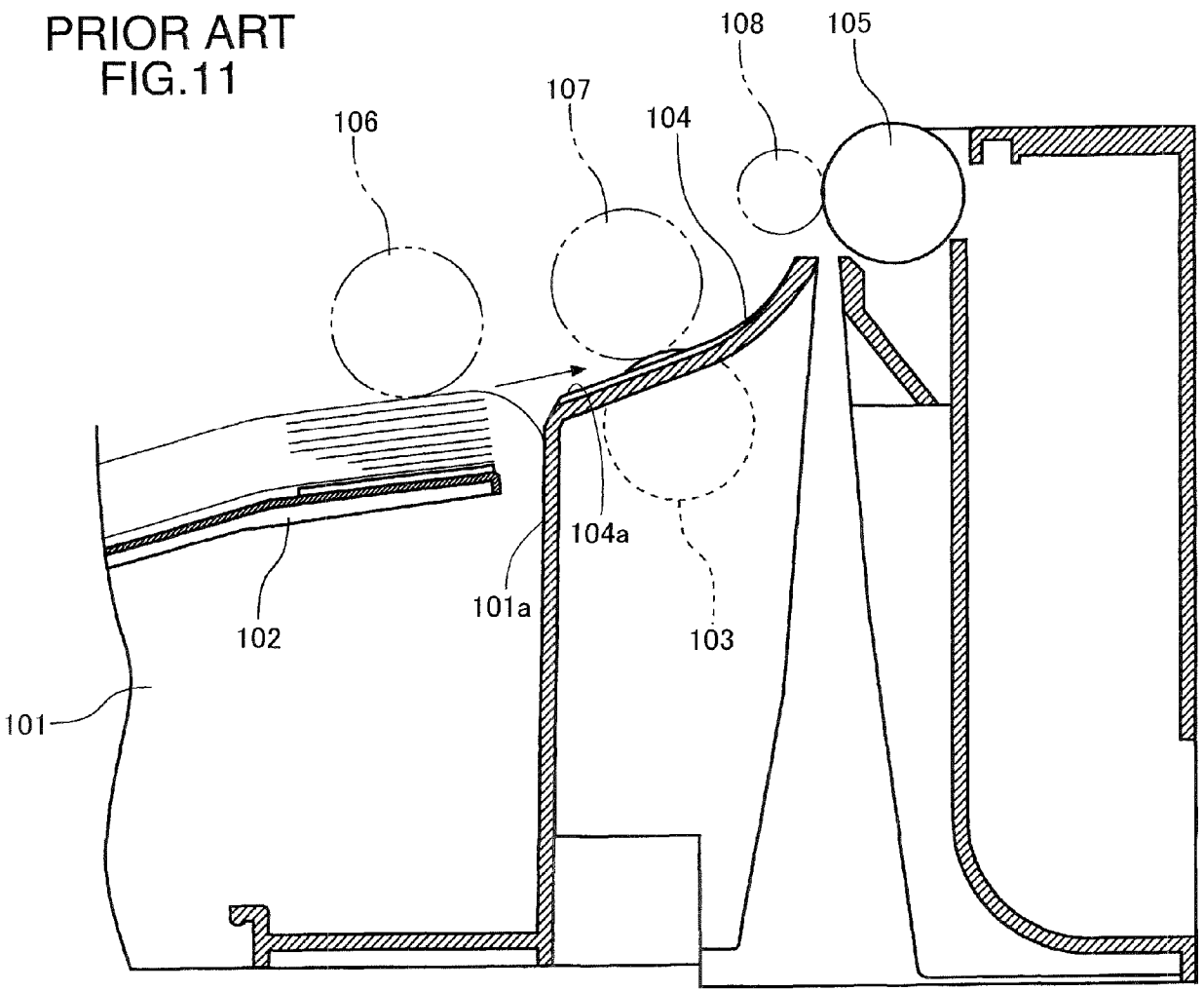
PRIOR ART FIG.11
FIG. 11 is a section showing an essential portion of the conventional sheet feeder shown in FIG. 10.

FIG. 1 is a perspective view of a printer provided with a sheet feeder according to one embodiment of the invention, FIG. 2 is a section showing the internal construction of the printer shown in FIG. 1, FIG. 3 is a perspective view showing a sheet cassette constituting the sheet feeder according to the embodiment of the invention, FIG. 4 is a perspective view showing the external appearance of the sheet feeder according to the embodiment of the invention, FIG. 5 is a diagram showing a state where the sheet cassette of the sheet feeder shown in FIG. 4 is drawn from a sheet feeder main body, FIG. 6 is a section along VI-VI of the sheet cassette shown in FIG. 3, FIG. 7 is a section along VII-VII of the sheet cassette shown in FIG. 3, FIG. 8 is a section showing an essential portion of the sheet feeder shown in FIG. 6, and FIG. 9 is a section showing an essential portion of the sheet feeder shown in FIG. 7.

A printer 1 as an example of an image forming apparatus according to the one embodiment of the present invention is provided with a printer main body (image forming apparatus main body) 20 and a sheet feeding device 30 provided below the printer main body 20. A sheet discharge unit 8 in the form of a sloping recess is formed on the upper surface of the printer main body 20.

The internal construction of the printer 1 is described below with reference to FIG. 2.

The printer main body 20 is connected with a personal computer or the like (not shown) and includes an imaging section (image forming section) 3 for forming a toner image based on image data received from the personal computer or the like, a transport path 5 for transporting a transfer sheet as fed from the sheet feeding device 30 to the imaging section 3, a transfer unit 6 for transferring the toner image formed in the imaging section 3 to the transfer sheet and a fixing unit 7 for fixing the toner image to the transfer sheet.

The printer 1 in accordance with the present embodiment is a color printer and a magenta unit 3M, a cyan unit 3C, a yellow unit 3Y and a black unit 3K are successively arranged from an upstream side (right side in FIG. 2) toward a downstream side along a rotating direction of a conveyor belt 9 in the imaging section 3.

The sheet feeding devices 30 include an upper sheet feeding device 30-1 and a lower sheet feeding device 30-2 arranged in two upper and lower levels, so that a transfer sheet can be selectively fed from the respective levels. Both a transfer sheet from the upper sheet feeding device 30-1 and a transfer sheet from the lower sheet feeding device 30-2 are conveyed to the imaging section 3 via the transport path 5.

The transfer sheet as transported to the imaging section 3 has toner images of the respective colors transferred thereto from the magenta unit 3M, the cyan unit 3C, the yellow unit 3Y and the black unit 3K while being conveyed on the conveyor belt 9. As a result, a color toner image is formed on the transfer sheet. Thereafter, the transfer sheet is conveyed to the fixing unit 7 to be pressed and heated therein, whereby the color toner image is fixed. Subsequently, the transfer sheet is discharged to the sheet discharge unit 8.

Each sheet feeding device includes a sheet feeding unit 13 in accordance with the present embodiment shown in FIGS. 4 to 7. As shown in FIGS. 4 and 5, the sheet feeding unit 13 includes a sheet feeding unit main body 13*b* and a sheet cassette 13*a* to be mounted in the sheet feeding unit main body 13*b*. The sheet cassette 13*a* is detachably mountable into the sheet feeding unit main body 13*b* by being inserted and withdrawn in attaching and detaching directions shown by arrows.

Each sheet feeding device further includes a pair of feed rollers (feed roller 22, separation roller 16) for conveying a transfer sheet stored in the sheet cassette 13*a*, a pair of transport rollers (transport roller 18, transport rollers 23,) disposed downstream of the respective feed rollers, and a driving unit 10 for driving these two pairs of rollers. The driving unit 10 is fixed at a specified position of the sheet feeding unit main body 13*b*.

Out of the feed roller pair, the feed roller 22 is disposed in the sheet feeding unit main body 13*b*, whereas the separation roller 16 is disposed in the sheet cassette 13*a*. With the sheet cassette 13*a* mounted in the sheet feeding unit main body 13*b*, the separation roller 16 of the sheet cassette 13*a* is held in contact with the feed roller 22 of the sheet feeding unit main body 13*b*.

Similarly, out of the transport rollers, the transport roller 23 is disposed in the sheet feeding unit main body 13*b*, whereas the transport rollers 18 are disposed in the sheet cassette 13*a*. With the sheet cassette 13*a* mounted in the sheet feeding unit main body 13*b*, the transport rollers 18 of the sheet cassette 13*a* are held in contact with the transport roller 23 of the sheet feeding unit main body 13*b*.

Upon mounting the sheet cassette 13*a* into the sheet feeding unit main body 13*b*, a lifter plate 15 is inclined about a shaft 12 with respect to a transport direction, and the downstream end thereof is moved in the transport direction, thereby bringing a downstream end of the uppermost transfer sheet in the transport direction into contact with a pickup roller 21. In this way, the sheet feeding unit (sheet feeder) 13 enters a state where it can feed a sheet.

Next, with reference to FIGS. 3 to 9, the construction of the sheet feeding unit 13 in accordance with the present embodiment is described.

As shown in FIGS. 4 and 5, the sheet feeding unit 13 includes the sheet feeding unit main body 13*b* and the sheet cassette 13*a* which can be detachably mounted into the sheet feeding unit main body 13*b*. The sheet cassette 13*a* is in the form of a drawer having an open upper side as shown in FIG.

3 and is withdrawn from the sheet feeding unit main body 13*b* to enable the replenishment and exchange of transfer sheets as shown in FIG. 5.

As shown in FIG. 3, the sheet cassette 13*a* includes a storing section 14 for storing transfer sheets, the lifter plate 15 for inclining the transfer sheets stored in the storing section 14 with respect to the transport direction (upward in FIG. 3), the separation roller 16 disposed at a position downstream of the lifter plate 15 in the transport direction to face the feed roller 22 with the sheet cassette 13*a* mounted in the sheet feeding unit main body 13*b*, a plurality of transport rollers 18 arranged in parallel downstream of the separation roller 16 and a transfer sheet guide 17 for guiding the transfer sheet to the transport rollers 18.

As shown in FIGS. 2, 7 and 9, the transfer sheet guide 17 includes a sloping guide 17*a* (guide face) formed in an area between the upper end edge of a vertical wall surface 14*a* at a downstream side of the storing section 14 in the transport direction and the separation roller 16 and adapted to guide the transfer sheet between the feed roller 22 and the separation roller 16. The sloping guide 17*a* is integrally formed with the upper end edge of the vertical wall surface 14*a*. The sloping guide 17*a* is formed to extend from the storing section 14 along the transport direction of the transfer sheet on or in a vicinity of an extension of a line $P_1$ tangent to the feed roller 22 and the transport roller 23 on the side of transporting the transfer sheet.

As shown in FIG. 9, the transfer sheet guide 17 in accordance with the present embodiment is formed such that an upstream end 17*b* of the sloping guide 17*a* in the transport direction is located below a line $P_2$ tangent to the pickup roller 21 and the feed roller 22 on the side of transporting the transfer sheet. Accordingly, the transfer sheet as fed from the storing section 14 is received by the sloping guide 17*a* even if hanging down along the vertical wall surface 14*a* upon being conveyed toward the feed roller 22. Further, the sloping guide 17*a* is formed on an extension line $P_1$ tangent to the feed roller 22 and the transport roller 23, i.e. to extend along the transport direction of the transfer sheet. Thus, the transfer sheet can be stably guided to a nip portion between the transport roller 23 and the transport roller 18 by the sloping guide (guide face) 17*a* of the transfer sheet guide 17.

It is preferable that the sloping guide 17*a* be formed on an extension of a line $P_1$ tangent to the feed roller 22 and the transport roller 23. However, the sloping guide 17*a* may be formed in a vicinity of the extension of the line $P_1$. In this case, it is preferable that the sloping guide 17*a* be formed below and in a vicinity of the extension line $P_1$, whereby the transfer sheet can be received under more stable conditions. It is also preferable that the sloping guide 17*a* be formed parallel to and in a vicinity of the line $P_1$ tangent to the feed roller 22 and the transport roller 23. However, the sloping guide 17*a* may be formed such that the upstream end thereof in the transport direction is located slightly below the extension of the line $P_1$.

The sheet cassette 13*a* in accordance with the present embodiment further includes a rib-shaped guide (rib-shaped member) 19 disposed upstream of the separation roller 16 in the transport direction, which prevents an uppermost transfer sheet as fed by the pickup roller 21 from being wound by the separation roller 16. As shown in FIG. 9, the rib-shaped guide 19 projects at an intermediate position of the outer surface of the sloping guide 17*a*. As shown in FIGS. 8 and 9, the rib-shaped guide 19 also functions as an accommodation portion for the separation roller 16.

The width of the rib-shaped guide 19 is not particularly limited as long as the foregoing effect of preventing the transfer sheet as fed from the storing section from being wound around the separation roller can be realized. However, it is preferable that the width of the rib-shaped guide 19 be formed substantially equal to the width of the separation roller 16 (width in a rotation axis direction orthogonal to the transport direction). Specifically, the foregoing effect of preventing the transfer sheet as fed from the storing section from being wound around the separation roller can be still realized, for example, from the structure wherein the rib-shaped guide 19 is made wider; however, it is likely that the collision of the transfer sheet dispensed from the sheet cassette 13*a* be generated. Accordingly, as in this embodiment, the rib-shaped guide 19 is formed to have substantially the same width as the separation roller 16. In this way, it is possible to effectively prevent the transfer sheet as being fed from being wound around the separation roller 16 while reducing an impact upon the collision of the leading end of the transfer sheet with the rib-shaped member.

Next, the sheet transport mechanism of the sheet feeding unit 13 according to this embodiment is described with reference to FIG. 9.

The conveying mechanism of the sheet feeding unit 13 according to this embodiment is constructed by the transfer sheet guide 17, the separation roller 16, the feed roller 22, the transport roller 23 and the transport rollers 18.

The transfer sheets placed on the lifter plate 15 are fed one by one from the uppermost one by the rotations of the pickup roller 21 to be guided to a nip portion between the feed roller 22 and the separation roller 16 while the uppermost one is being pressed against the pickup roller 21. At this time, only the uppermost one of the transfer sheets as fed by the pickup roller 21 passes between the pair of transport rollers 23 and 18 disposed at the downstream side and is conveyed to the imaging section (image forming section) 3 of the printer main body 20 since the feed roller 22 is rotated in the sheet transport direction and the separation roller 16 is rotated in a direction opposite to the sheet transport direction.

In this way, the feed roller 22 and the separation roller 16 constitute a multiple-feed preventing mechanism for feeding the transfer sheet one by one to the transport path, thereby preventing the transfer sheet(s) stacked on the lifter plate 15 under the uppermost one from being conveyed together with the uppermost one.

Here, in addition to the foregoing effect of preventing the transfer sheet as fed from the storing section from being wound around the separation roller, the rib-shaped guide 19 of the present embodiment also functions as a guide member for stably guiding the transfer sheet as fed from the storing section 14 by the pickup roller 21 to the transport path as described below.

Specifically, as shown in FIG. 9, the rib-shaped guide 19 includes a leading end face 19*a* to be in contact with the transfer sheet, the leading end face being inclined to extend toward a nip portion between the separation roller 16 and the feed roller 22 as shown by a reference numeral S. Thus, the transfer sheet as fed from the storing section 14 can be reliably guided to the nip portion between the feed roller 22 and the separation roller 16 located on an extension line by the leading end face 19*a* of the rib-shaped guide 19.

Although the explanations have been given through the case where the sheet feeder of the present invention is applied to the printer 1, the present invention is not limited this structure. The sheet feeder of the present invention can be applied to image forming apparatuses in general such as printers, copiers, facsimile machines and complex machines having multiple functions of these.

The aforementioned specific embodiment mainly embraces inventions having the following constructions.

One aspect of the present invention is directed to a sheet feeder, comprising: a storing section for storing transfer sheets; a feed roller for feeding the transfer sheets stored in the storing section one by one from the uppermost one; a separation roller arranged to face the feed roller; a transport roller arranged downstream of the feed roller in a transport direction; and a transfer sheet guide for guiding the transfer sheet to the transport roller, wherein the transfer sheet guide includes a guide face formed to extend from the storing section along the transport direction of the transfer sheet on or in a vicinity of an extension of a line tangent to the feed roller and the transport roller on the side of transporting the transfer sheet, the guide face being formed in an area between the storing section and the separation roller.

According to the foregoing structure, the transfer sheet guide for guiding the transfer sheet to the transport roller is formed in the area between the storing section and the separation roller, and includes a guide face formed to extend from the storing section along the transport direction of the transfer sheet on or in a vicinity of an extension of a line tangent to the feed roller and the transport roller on the side of transporting the transfer sheet, the guide face being formed in an area between the storing section and the separation roller. Thus, even if the leading end of the transfer sheet as fed from the storing section hangs down due to softness peculiar to the transfer sheet, the foregoing guide face extending from the storing section in the transport direction would receive the transfer sheet. Further, this guide face is formed to be located on the extension of the line tangent to the feed roller and the transport roller, to extend along the transport direction of the transfer sheet. Thus, the transfer sheet can be stably guided to the transport roller by the guide face of the transfer sheet guide. Therefore, the transfer sheet can be stably conveyed to the transport path and the generation of noise and a transfer sheet jam resulting from a conveyance failure of the transfer sheet can be reduced.

It may be arranged that the guide face of the transfer sheet guide is formed below and in a vicinity of the extension of the line tangent to the feed roller and the transport roller.

According to the foregoing structure, it is possible to more reliably receive the leading end of the transfer sheet hanging down upon the feed from the storing section.

It is preferable that a pickup roller be provided which contacts the uppermost surface of the transfer sheets stored in the storing section to feed the uppermost transfer sheet, wherein an upstream end of the guide face of the transfer sheet guide in the transport direction is located below a line tangent to the pickup roller and the feed roller on the side of transporting the transfer sheet.

According to the foregoing structure, the transfer sheet as fed from the storing section toward the feed roller is reliably received by the transfer sheet guide whose upstream end in the transport direction is located below a line tangent to the pickup roller and the feed roller on the side of transporting the transfer sheet. As a result, the transfer sheet as fed from the storing section can be guided to the transport path under stable conditions.

It is preferable to further comprise a rib-shaped member that projects from the outer surface of the transfer sheet guide on an upstream side of the separation roller in the transport direction and that prevents the transfer sheet as fed from the storing section from being wound around the separation roller.

According to the foregoing structure, the transfer sheet can be prevented from being wound around the separation roller rotating in the direction opposite to the transport direction of the transfer sheet before being guided to a nip portion between the feed roller and the separation roller by the transfer sheet guide. As a result, the transfer sheet can be guided to the transport path under more stable conditions.

It is also preferable that the rib-shaped member be formed to have substantially the same width as the separation roller.

According to the foregoing structure, it is possible to effectively prevent the transfer sheet as fed from being wound around the separation roller while reducing an impact upon the collision of the leading end of the transfer sheet with the rib-shaped member.

It is preferable that the rib-shaped member have a leading end face to be in contact with the transfer sheet, the leading end face being inclined to extend toward a nip portion between the separation roller and the feed roller.

According to the foregoing structure, it is possible to guide under stable conditions, the transfer sheet as being fed from the storing section to the nip portion between the feed roller and the separation roller located on an extension line of the leading end face by the leading end face of the rib-shaped member. It is therefore possible to guide the transfer sheet to the transport path under stable conditions.

An image forming apparatus according to another aspect of the present invention comprises a sheet feeder including a storing section for storing transfer sheets; a feed roller for feeding the transfer sheets stored in the storing section one by one from the uppermost one; a separation roller arranged to face the feed roller; a transport roller arranged downstream of the feed roller in a transport direction; and a transfer sheet guide for guiding the transfer sheet to the transport roller, wherein the transfer sheet guide includes a guide face formed to extend from the storing section along the transport direction of the transfer sheet on or in a vicinity of an extension of a line tangent to the feed roller and the transport roller on the side of transporting the transfer sheet, the guide face being formed in an area between the storing section and the separation roller.

According to the foregoing structure, it is possible to transfer the transfer sheet as fed from the storing section to the image forming apparatus main body under stable conditions. As a result, the generation of noise and a jam resulting from a conveyance failure of the transfer sheet can be reduced.

It is preferable that the guide face of the transfer sheet guide be formed below and in a vicinity of the extension of the line tangent to the feed roller and the transport roller.

It is further preferable that a pickup roller be provided which contacts the uppermost surface of the transfer sheets stored in the storing section to feed the uppermost transfer sheet, wherein an upstream end of the guide face of the transfer sheet guide in the transport direction is located below a line tangent to the pickup roller and the feed roller on the side of transporting the transfer sheet.

It is preferable that a rib-shaped member be further provided to project from the outer surface of the transfer sheet guide on an upstream side of the separation roller in the transport direction and adapted to prevent the transfer sheet as fed from the storing section from being wound around the separation roller.

It is preferable that the rib-shaped member be formed to have substantially the same width as the separation roller.

It is also preferable that the rib-shaped member have a leading end face to be contact with the transfer sheet as being transported, the leading end face being inclined to extend toward a nip portion between the separation roller and the feed roller.

According to each of the foregoing structures, it is possible to guide the transfer sheet as fed from the storing section to the image forming apparatus main body under stable conditions. As result, the generation of noise and a jam resulting from a conveyance failure of the transfer sheet can be reduced.

This application is based on Japanese Patent application serial No. 2007-197062 filed in Japan Patent Office on Jul. 30, 2007, the contents of which are hereby incorporated by reference.

The specific embodiment or example given in the detailed description of the invention is to elucidate the technical contents of the invention and the invention should not be narrowly interpreted by being limited only to the specific example. Various changes can be made within the spirit of the invention and the scope as claimed.

What is claimed is:

1. A sheet feeder, comprising:

a storing section for storing transfer sheets;

a feed roller for feeding the transfer sheets stored in the storing section one by one from an uppermost one;

a separation roller arranged to face the feed roller;

a transport roller arranged downstream of the feed roller in a transport direction;

a lifter plate in the storing section and including a downstream end, the lifter plate being rotatable about an axis upstream of the downstream end, the downstream end being configured to lift up leading edges of the transfer sheets in the storing section to define an upward transport direction in cooperation with the feed roller and the transport roller;

a pickup roller that contacts the uppermost surface of the transfer sheets stored in the storing section to feed the uppermost transfer sheet; and transfer sheet guide for guiding the transfer sheet to the transport roller, the transfer sheet guide includes a guide face formed to extend from the storing section along the upward transport direction of the transfer sheet substantially on an extension of a line tangent to the feed roller and the transport roller on the side of transporting the transfer sheet, said guide face being formed in an area between the storing section and the separation roller, an upstream end of the guide face of the transfer sheet guide in the transport direction being positioned below a line tangent to the pickup roller and the feed roller on the side of transporting the transport sheet.

2. The sheet feeder of claim 1, further comprising: a rib-shaped member that projects from the outer surface of the transfer sheet guide on an upstream side of the separation roller in the transport direction and that prevents the transfer sheet as fed from the storing section from being wound around the separation roller.

3. The sheet feeder of claim 2, wherein the rib-shaped member is formed to have substantially the same width as the separation roller.

4. The sheet feeder of claim 2, wherein:

the rib-shaped member has a leading end face to be in contact with the transfer sheet as being transported, said leading end face being inclined to extend toward a nip portion between the separation roller and the feed roller.

5. An image forming apparatus, comprising:

a sheet feeder including:

a storing section for storing transfer sheets, a feed roller for feeding the transfer sheets stored in the storing section one by one from the uppermost one, a separation roller arranged to face the feed roller, a transport roller arranged downstream of the feed roller in a transport direction, and an image forming apparatus main body for forming an image on the transfer sheet as fed from the sheet feeder, a lifter plate in the storing section and including a downstream end, the lifter plate being rotatable about an axis upstream of the downstream end, the downstream end being configured to lift up leading edges of the transfer sheets in the storing section to define an upward transport direction in cooperation with the feed roller and the transport roller, and a pickup roller that contacts the uppermost surface of the transfer sheets stored in the storing section to feed the uppermost transfer sheet, a transport sheet guide for guiding the transfer sheet to the transport roller, the transfer sheet guide includes a guide face formed to extend from the storing section along the upward transport direction of the transfer sheet substantially on an extension of a line tangent to the feed roller and the transport roller on the side of transporting the transfer sheet, said guide face being formed in an area between the storing section and the separation roller, an upstream end of the guide face of the transfer sheet guide in the transport direction being positioned below a line tangent to the pickup roller and the feed roller on the side of transporting the transport sheet.

6. The image forming apparatus of claim 5, further comprising: a rib-shaped member that projects from the outer surface of the transfer sheet guide on an upstream side of the separation roller in the transport direction and that prevents the transfer sheet as fed from the storing section from being wound around the separation roller.

7. The image forming apparatus of claim 6, wherein the rib-shaped member is formed to have substantially the same width as the separation roller.

8. The image forming apparatus of claim 6, wherein: the rib-shaped member has a leading end face to be in contact with the transfer sheet as being transported, said leading end face being inclined to extend toward a nip portion between the separation roller and the feed roller.

9. A sheet feeder, comprising:

a storing section for storing transfer sheets;

a pick-up roller opposed to the storing section for contacting an upper surface of an uppermost transfer sheet stored in the storing section and feeding the uppermost transfer sheet from the storing section in a transport direction;

a feed roller arranged downstream of the pick-up roller in the transport direction and disposed for contacting the upper surface of the uppermost transfer sheet fed by the pick-up roller and feeding the transfer sheet in the transport direction;

a separation roller arranged to face the feed roller and to contact a lower surface of the transfer sheet;

a transport roller arranged downstream of the feed roller in the transport direction and disposed for contacting the upper surface of the transfer sheet fed by the feed roller;

a lifter plate in the storing section and including a downstream end, the lifter plate being rotatable about an axis upstream of the downstream end, the downstream end being configured to lift up leading edges of the transfer sheets in the storing section to define an upward transport direction in cooperation with the feed roller and the transport roller; and a transfer sheet guide spaced downstream from the storing section for upwardly guiding the transfer sheet to the transport roller, the transfer sheet guide including a guide face substantially coincident with an extension of a line that is tangent to both the feed roller and the transport roller, the guide face being between the storing section and the separation roller, an upstream end of the guide face of the transfer sheet guide in the transport direction being positioned below a line tangent to the pickup roller and the feed roller on the side of transporting the transport sheet.

* * * * *